US007703183B2

(12) United States Patent
Weng

(10) Patent No.: US 7,703,183 B2
(45) Date of Patent: Apr. 27, 2010

(54) COIL ZIPPER STRUCTURE

(76) Inventor: Wen-Chun Weng, 6F., No. 1, Chengde St., Xinzhuang City, Taipei County (TW)

( * ) Notice: Subject to any disclaimer, the term of this patent is extended or adjusted under 35 U.S.C. 154(b) by 248 days.

(21) Appl. No.: 11/855,908

(22) Filed: Sep. 14, 2007

(65) Prior Publication Data

US 2009/0070968 A1 Mar. 19, 2009

(51) Int. Cl.
*A44B 1/04* (2006.01)

(52) U.S. Cl. ..... 24/391; 24/396

(58) Field of Classification Search ..... 24/391, 24/394

See application file for complete search history.

(56) References Cited

U.S. PATENT DOCUMENTS 2,300,442 A * 11/1942 Wahl ..... 24/393
5,167,051 A * 12/1992 Kousaka ..... 24/391
6,230,373 B1 * 5/2001 Wakai et al. ..... 24/381
7,445,741 B2 * 11/2008 Poulakis et al. ..... 264/254
7,520,032 B2 * 4/2009 Kousaka et al. ..... 24/395
2004/0154144 A1 * 8/2004 Yoneoka et al. ..... 24/391

FOREIGN PATENT DOCUMENTS

TW M262054 9/2004
TW M263797 11/2004

* cited by examiner

*Primary Examiner*—Robert J Sandy
*Assistant Examiner*—Michael Lee
(74) *Attorney, Agent, or Firm*—Apex Juris, pllc; Tracy M Heims

(57) ABSTRACT

A coil zipper structure for elongating the life time of the conventional zipper that includes a first coil and a second coil, wherein the first coil and the second coil are respectively formed by linking plural engaging rings, and each engaging ring has a teeth portion for mutual engagement; and a sliding element, mounted between the first coil and the second coil for separating or engaging the engaging rings, wherein the engaging ring has an upper edge portion and a lower edge portion, in which the lower edge portion is fixed on a base cloth and the upper edge portion has a strengthened flat surface. Since the upper edge portion of the engaging ring is the strengthened flat surface, the collision or pulling and dragging between the sliding element and the upper edge portion can be reduced, so as to elongating the life time of the zipper.

4 Claims, 3 Drawing Sheets

COIL ZIPPER STRUCTURE

FIELD OF THE INVENTION

The present invention is related to a zipper structure, and more particularly to a coil zipper structure formed by twisting polyester filaments.

BACKGROUND OF THE INVENTION

A zipper is widely utilized in our modern life which is a device for temporarily combining two flexible materials and is primarily applied to cloth, leather or other textile products. According to the structural difference, zippers can be divided into two types: coil form and individual form. The coil zipper is advantageous for convenient manufacturing procedure, low cost and easily being processed, so that it is widely used in ready-made clothes. The coil zipper is formed by twisting polyester filaments, and thus, it is also called a polyester zipper. Also, in the past the zipper is always formed by nylon, so that it is also called a nylon zipper. The common coil zipper, as shown in FIG. 1 and FIG. 2, includes two different coils 3, 3*a* which are sewn on different base cloths 2, 2*a* by stitches 1, and the coils 3, 3*a* respectively have plural chain teeth 4. Between the coils 3, 3*a*, a slider 5 is mounted, and through a back and forth movement of the slider 5, the chain teeth 4 on the coils 3, 3*a* will be combined or separated, so as to temporarily combine or separate the two base cloths 2, 2*a*. The slider 5 has a track 6 for penetrating the coils 3, 3*a*, and since the common coils 3, 3*a* may respectively have a slightly protruded curve 7 at the top thereof, when the slider 5 slides back and forth, the tops of the coils 3, 3*a* might collide with the track 6 owing to an excessive forcing or an incorrect forcing direction. Further, because the coil zipper is formed by polyester filament, which is not as tough as the metal material, it might be easily destroyed by an excessive collision. Besides, the stitches 1 are also wound around the tops of the coils 3, 3*a*, so that when the slider 5 is sliding, the stitches 1 might rub against the inner side of the track 6 and carelessly pull and drag the coils 3, 3*a*, and thus, after a long term using, the stitches might be broken or come off, or the coils 3, 3*a* might be deformed, such that the connection between the coils 3, 3*a* and the base cloths 2, 2*a* will be influenced.

In the conventional patents of R.O.C. patents No. M262054 and No. M263797, the improved structures of the nylon zipper are disclosed, in which the top surfaces of the two chain teeth, or both the top and the bottom surfaces of the two chain teeth are formed to have a stitch indentation for positioning the stitches, and since the stitches are limited by the stitch indentation, the situations that the stitches wind around the chain teeth, come off and rub against the slider can be prevented. However, because the surface of the chain teeth is small, the addition of the stitch indentation might reduce the strength of the zipper structure, so that it actually is difficult to install the stitch indentation and the cost might also be increased thereby. Consequently, the technology of the two conventional patents also can not effectively solve the deformation problem of chain teeth which is caused by the slider colliding with or pulling and dragging the chain teeth as sliding.

SUMMARY OF THE INVENTION

The object of the present invention is to reduce the possibility of the coils to be collided by the sliding element or be pulled and dragged by the sliding element and enhance the resistance of the coils as being collided or pulled and dragged by the sliding element, so as to increase the life time of the zipper.

Another object of the present invention is to increase the brightness of light reflection, so as to increase the decoration effect of the zipper.

For achieving the objects described above, the present invention provides a coil zipper structure that includes a first coil and a second coil, wherein the first coil and the second coil are respectively formed by linking plural engaging rings, and each engaging ring has a teeth portion for mutual engagement; and a sliding element, mounted between the first coil and the second coil for separating or engaging the engaging rings, wherein the engaging ring has an upper edge portion and a lower edge portion, wherein the lower edge portion is fixed on a base cloth and the upper edge portion has a strengthened flat surface. Besides, an interval is formed between the strengthened flat surface of the upper edge portion and the sliding element, and the height of the interval is at least larger than the thickness of a stitch wound on the engaging ring.

Through the technology described above, the present invention is advantageous that: the collision or pulling and dragging between the coils and the sliding element will not occur easily, the deformation of the coils caused from the collision or pulling and dragging by the sliding element can be prevented through the increased strength of the coils, so as to elongate the life time of the zipper, and the strengthened flat surface can further increase the light reflection area and brightness, so as to achieve a decoration effect.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
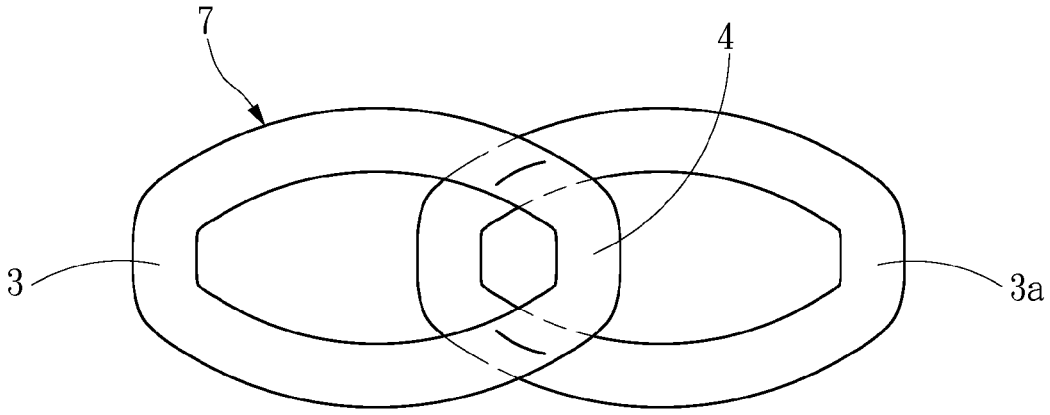
Fig. 1 PRIOR ART
FIG. 1 is a sectional view showing the coil portion of a conventional coil zipper.
Figure 2:
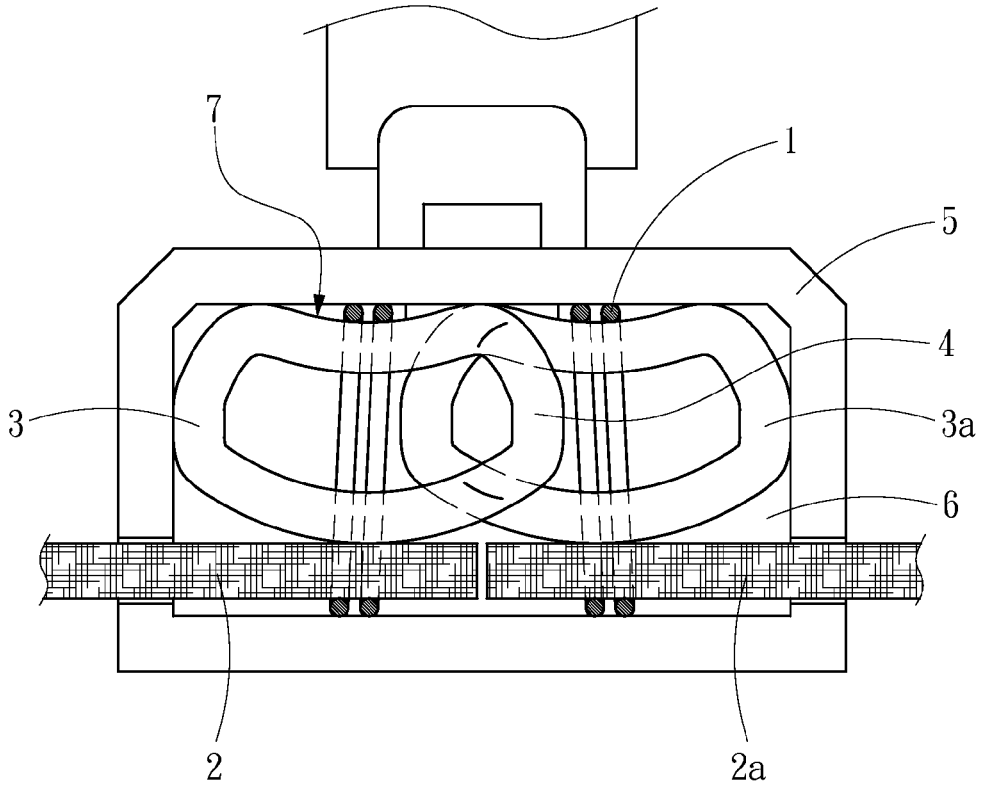
Fig. 2 PRIOR ART
FIG. 2 is a sectional view showing the combination of a coil with a sliding element of a conventional coil zipper.
Figure 3:
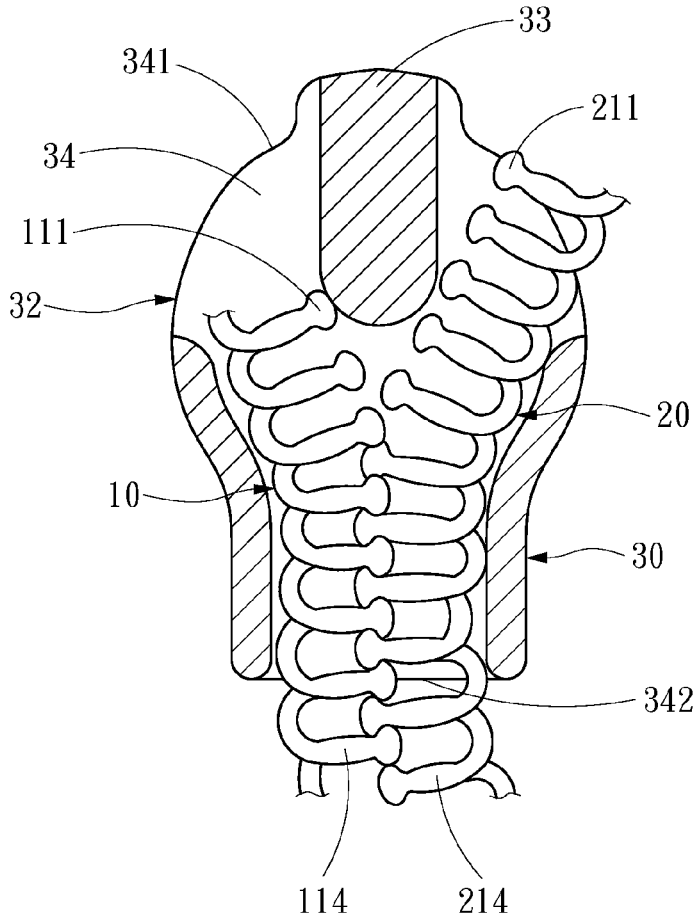
FIG. 3 is an appearance plan view showing a preferred embodiment according to the present invention.
Figure 4:
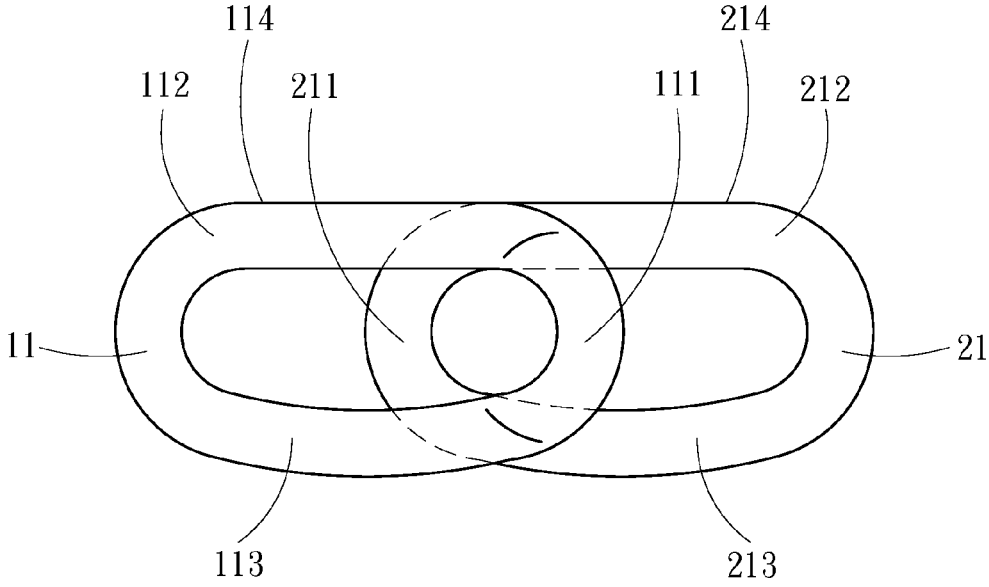
FIG. 4 is a sectional view showing a coil portion in a preferred embodiment according to the present invention.
Figure 5:
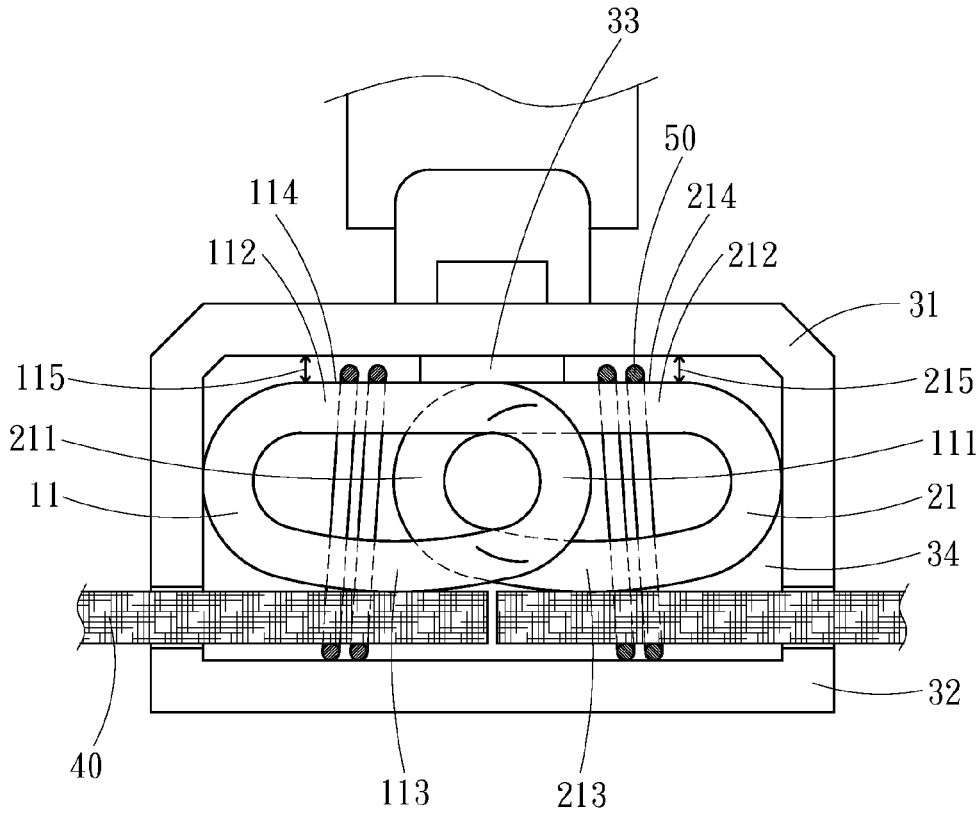
FIG. 5 is a sectional view showing a combination of a coil with a sliding element in a preferred embodiment according to the present invention.

Please refer to FIG. 3 and FIG. 4, which are respectively an appearance plan view and a sectional view of a preferred embodiment in the present invention. As shown, the present invention provides a coil zipper structure including a first coil 10 and a second coil 20, wherein the first coil 10 and the second coil 20 are respectively formed by linking plural engaging rings 11, 21, and each engaging ring 11, 21 has a teeth portion 111, 211 for mutual engagement, and a sliding element 30 is mounted between the first coil 10 and the second coil 20 for separating or engaging the engaging rings 11, 21. In this embodiment, as shown in FIG. 3 and FIG. 5, the sliding element 30 includes an upper flank portion 31 and a lower flank portion 32 which are connected by a partition pillar 33 so that a Y shape track is formed among the upper flank portion 31, the lower flank portion 32 and the partition pillar 33. The track 34 includes two separating ends 341 and one engaging end 342, wherein the engaging rings 11, 21 of the first coil 10 and the second coil 20 will respectively enter the separating ends 341 of the track 34, be guided by the partition pillar 33 for engaging with each other, and leave the sliding element 30 through the engaging end 342.

In the present invention, the engaging ring 11, 21 is sewn on the base cloth 40 by stitches 50. The engaging ring 11, 21 has an upper edge portion 112, 212 and a lower edge portion 113, 213 and the stitches 50 are repeatedly wound at the positions which locate at the lower side of the upper edge portion 112, 212 and the base cloth 40 and closely press the engaging ring 11, 21, so that the lower edge portion 113, 213 can be fixed on the base cloth 40. Each upper edge portions 112, 212 have a strengthened flat surface 114, 214 at the same level for positioning the stitches 50. The strengthened flat surface 114, 214 can be formed by plastic pressing after twisting the first and the second coils 10, 20. However, the manufacturing method is not limited. Besides, an interval 115, 215 is respectively formed between the strengthened flat surface 114, 214 of the upper edge portion 112, 212 and the sliding element 30 for preventing the collision between the inner edge of the sliding element 30 and the engaging ring 11, 21 when the sliding element 30 and the first and the second coils 10, 20 have a relative movement. Since the stitches 50 are wound at the upper edge portion 112, 212 of the engaging ring 11, 21, the height of the interval 115, 215 should be at least larger than the height of the stitches 50 on the engaging rings 11, 21, so as to avoid the stitches 50 from coming off that might be caused from the rubbing between the stitches 50 and the inner edge of the track 34 as sliding of the sliding element 30 and also avoid a permanent deformation of the first and the second coils 10, 20 which might be caused from careless collision or pulling and dragging.

As shown in FIG. 3, the strengthened flat surface 114, 214 is formed by pressing the upper edge portion 112, 212 after twisting the first and the second coils 10, 20, such that the width of the strengthened flat surface 114, 214 will be wider than the diameter of the first and the second coils 10, 20. Here, since the widening direction of the strengthened flat surface 114, 214 and the sliding direction of the sliding element 30 are identical, even the strengthened flat surface 114, 214 is collided or pulled and dragged during the sliding element 30 sliding, the first and the second coils 10, 20 will no longer become damaged or deformed. Besides, after plastic pressing, the strengthened flat surface 114, 214 will have a higher density and may become a more compact material. Therefore, the structures of the strengthened flat surface 114, 214 can substantially enhance the strength of the first and the second coils 10, 20.

Figure 6:
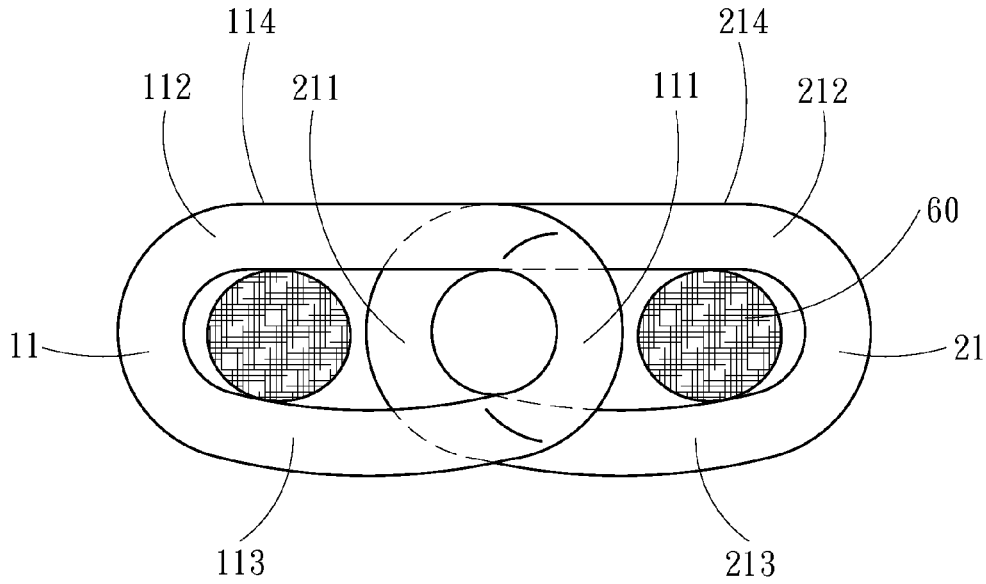
FIG. 6 is a sectional view showing a coil portion in another preferred embodiment according to the present invention.

Please refer to FIG. 6, which is a sectional view showing another embodiment according to the present invention. As shown, the coil zipper structure of the present invention includes a core line 60 respectively penetrating through the engaging rings 11, 21, wherein the core line 60 can be made of nylon or cotton yarn, so as to increase the strength of the first and the second coils 10, 20 and also to prevent the permanent deformation of the first and the second coils 10, 20 which is caused by collision or pulling and dragging from the sliding element 30 owing to user's excessive forcing.

In the aforesaid, according to the coil zipper structure of the present invention, the upper edge portion 112, 212 of the engaging ring 11, 21 has formed to be the strengthened flat surface 114, 214, and further, the interval 115, 215 is formed between the strengthened flat surface 114, 214 and the sliding element 30. The interval 115, 215 is formed to effectively prevent the collision between the sliding element 30 and the engaging rings 11, 21 of the first and the second coils 10, 20, or prevent the stitches 50 from winding around the upper edge portions 112, 212 and then coming off which might cause the connection between the first and the second coils 10, 20 and the base cloth 40 unstable. In addition, as compared with the conventional coil zipper, the strengthened flat surface 114, 214 can reduce the protruding area of the engaging ring 11, 21, so that the first and the second coils 10, 20 can have a more stable structure and can have a longer life time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A coil zipper structure, comprising:

a first coil and a second coil, wherein the first coil and the second coil are respectively formed by linking plural engaging rings, and each engaging ring has a teeth portion for mutual engagement; and a sliding element, mounted between the first coil and the second coil for separating or engaging the engaging rings, wherein the engaging rings are sewn on a base cloth by stitches and each engaging ring has an upper edge portion and a lower edge portion, wherein the lower edge portion is fixed on a base cloth and the upper edge portion has a strengthened flat surface at the same level of an upper portion of the stitches, and the stitches are wound on the strengthened flat surface, the strengthened flat surface being of higher density and a more compact material.

2. The coil zipper structure as claimed in claim 1, characterized in that an interval is formed between the strengthened flat surface of the upper edge portion and the sliding element.

3. The coil zipper structure as claimed in claim 2, characterized in that the height of the interval is at least larger than the thickness of a stitch wound on each engaging ring.

4. The coil zipper structure as claimed in claim 1, characterized in that the first coil and the second coil respectively have a core line penetrating in each engaging ring.

* * * * *